US006938292B1

(12) United States Patent
Iannacone, Jr.

(10) Patent No.: US 6,938,292 B1
(45) Date of Patent: Sep. 6, 2005

(54) CARPET TRIMMER AND TUCKER

(75) Inventor: Charles P. Iannacone, Jr., Gilbert, AZ (US)

(73) Assignee: Quick Tuck, LLC, Mesa, AZ (US)

( * ) Notice: Subject to any disclaimer, the term of this patent is extended or adjusted under 35 U.S.C. 154(b) by 166 days.

(21) Appl. No.: 10/359,315

(22) Filed: Feb. 5, 2003

(51) Int. Cl.[7] ..... A47G 27/04
(52) U.S. Cl. ..... 7/103; 30/294
(58) Field of Search ..... 7/103, 158; 30/125, 30/287, 294

(56) References Cited

U.S. PATENT DOCUMENTS

| | | | | |
|---|---|---|---|---|
| 2,635,332 | A | 4/1953 | Huntington | |
| 2,770,032 | A | 1/1956 | Kelly | |
| 2,761,199 | A | 9/1956 | Allen | |
| 3,127,299 | A | 3/1964 | Hecht | |
| 3,363,314 | A | 1/1968 | O'Brien | |
| 3,395,453 | A | 8/1968 | Prater | |
| 3,538,523 | A | 11/1970 | Sparks | |
| 3,546,726 | A | 12/1970 | Bizzigotti | |
| 3,621,573 | A | 11/1971 | Summers | |
| 3,737,932 | A | 6/1973 | Armijo | |
| 3,934,341 | A | 1/1976 | Carlson | |
| 4,095,341 | A | 6/1978 | Crain | |
| 4,314,395 | A | 2/1982 | Brock | |
| 4,605,253 | A | 8/1986 | Anderson | |
| 4,669,190 | A | 6/1987 | Innami et al. | |
| 4,750,226 | A | 6/1988 | Costill | |
| 4,790,059 | A | 12/1988 | Killpack | |
| 4,949,604 | A | 8/1990 | Squires | |
| 5,044,081 | A * | 9/1991 | Nguyen | 30/294 |
| 5,203,852 | A | 4/1993 | Downing et al. | |
| 5,438,757 | A * | 8/1995 | Weschenfelder | 7/103 |
| 5,881,463 | A * | 3/1999 | Casteel et al. | 30/294 |
| 5,984,392 | A | 11/1999 | Iannacone, Jr. | |
| 6,421,923 | B1 * | 7/2002 | Nguyen | 30/294 |
| 6,792,634 | B1 * | 9/2004 | Mills et al. | 7/103 |

FOREIGN PATENT DOCUMENTS

| | | |
|---|---|---|
| NL | 7513571 | 5/1976 |

* cited by examiner

*Primary Examiner*—James G. Smith
(74) *Attorney, Agent, or Firm*—Booth Udall, PLC

(57) ABSTRACT

The invention is a bi-directional carpet trimmers and tucker. The trimmers may be adjusted or sized to trim the carpet edge to the correct length for tucking. At least two trimmers are provided, one for each direction of operation. The height offset of the trimmers above the carpet trimmer and tucker baseplate may be fixed or may be adjustable to allow for variances in carpet thickness and different depths of the tucking trough. Guides extend from the trimmers to slidingly or rollingly engage the wall or baseboard and to orient the trimmers. The trimmer blades are oriented horizontally. The invention also includes a retrofit trimmer for existing carpet tuckers. The retrofit kit comprises a replacement handle, or grip, with integral or attachable trimmers extending to align with the wheels of existing 3-wheeled carpet trimmers.

21 Claims, 8 Drawing Sheets

100
101
102
103
104
104
115
116
120
121
122
122
124
127
127
127
128
128
129
132
200
200
202
202
204
224
224
225
225
227
227
227
250
300

224
202
306
305
304
303
200
301

202
225
200
227

224
202
204
200
227

224
202
227
200
300
301

303
227
200
202
224
225
128
127
126
129
124
120

CARPET TRIMMER AND TUCKER

BACKGROUND OF THE INVENTION

1. Technical Field

This invention relates generally to hand tools used in laying carpet. It relates more specifically to a hand tool which both trims and tucks carpet edges.

2. Background

A carpet tucker is a tool which tucks the edge of a carpet adjacent to a wall or baseboard in order to give the carpet a finished appearance. Tucking presses the edge of the carpet firmly into a tucking trough formed between a tacking strip and a wall or baseboard. U.S. Pat. No. 5,984,392 to Iannacone, (the "'392 patent", the disclosure of which is hereby incorporated herein by reference, which was invented by the inventor of the present application) discloses a multi-wheeled carpet tucker which works bidirectionally. FIG. 7 of the '392 patent shows the carpet in position to be tucked. FIG. 8 of the '392 patent shows the carpet tucker in operation.

Carpet trimmers of various sorts are known in the art. Carpet trimmers conventionally have vertically-oriented cutting edges and are used to cut the carpet separately from tucking the carpet. Accordingly, what is needed is a tool that both trims and tucks in one motion.

SUMMARY OF THE INVENTION

Accordingly, embodiments of the present relate to a bi-directional carpet tucker with attached trimmers. The trimmers may be adjusted or sized to cut the carpet to the correct length for tucking. At least two trimmers are provided, one for each of the two directions of operation. A trimmer has a base structure which provides the trimmer blade a height offset from the baseplate of the carpet tucker. The height offset of the trimmers above the baseplate is one factor which determines the extent of tuckable carpet edge that the trimmers will produce. The height offset of the trimmers above the baseplate may be fixed or may be adjustable to allow for variances in carpet thickness and different depths of the tucking trough. Guides extend from the trimmers to slidingly engage the wall or baseboard to orient the trimmers to cut the carpet edge parallel to the wall or baseboard. The trimmer blades of the trimmers are oriented horizontally. Embodiments of the present invention also relate to a retrofit trimmer kit, or retrofit kit, for existing carpet tuckers. The retrofit kit comprises a replacement handle with integral trimmers extending to align with the wheels of existing 3-wheeled carpet trimmers.

BRIEF DESCRIPTION OF THE DRAWINGS

The foregoing and other features and advantages of the carpet trimmer and tucker will be apparent from the following more particular description of specific embodiments of the carpet trimmer and tucker, as illustrated in the accompanying drawings, wherein.

DETAILED DESCRIPTION OF EMBODIMENTS OF THE INVENTION

Figure 1:
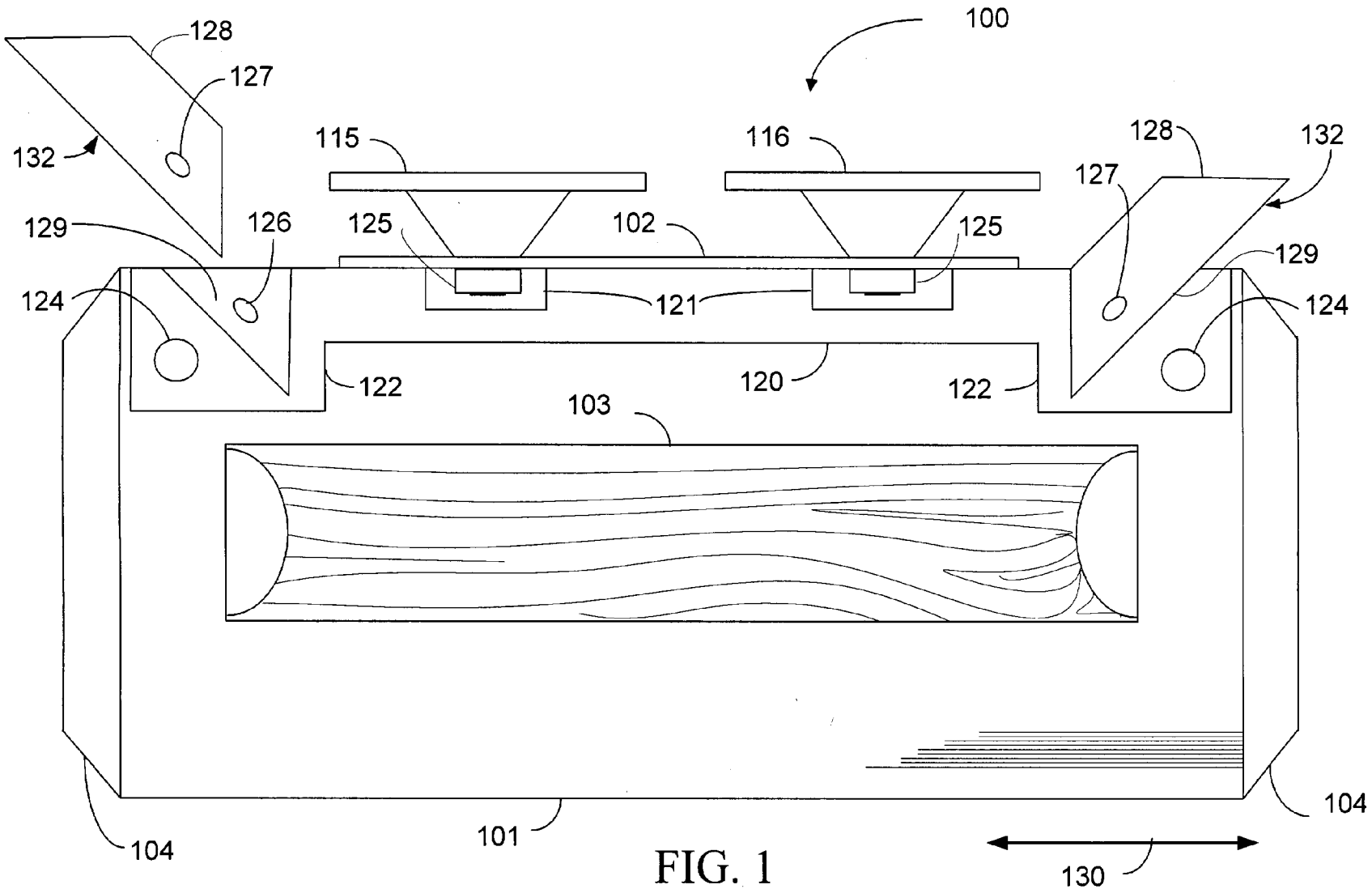
FIG. 1 is a top plan view of an exemplary embodiment of the carpet trimmer and tucker without the trimmer cover plates installed.

Referring now to the figures, FIG. 1 shows a top plan view of an exemplary embodiment of a carpet trimmer and tucker 100 having baseplate 101, handle 103, and a plurality of wheels 115–116 mounted on vertical wheel support flange 102. The baseplate 101 has upturned ends 104 to enable the baseplate 101 to slide easily in either direction 130. Trimmer base structures 122 are shown as shaped metal blocks integral to alignment bar 120. The top surface of trimmer base structures 122 may have an indentation 129. Indentation 129 may form part of a cavity for receiving and holding trimmer blade 128. Indentation 129 further comprises at least one bore 126 which aligns with at least one bore 127 in trimmer blade 128 to receive a retaining mechanism which will be discussed more fully below.

Referring to FIG. 1, the trimmer blade 128 on the left side of the drawing is shown outside the indentation 129, whereas trimmer blade 128 on the right side of the drawing is shown in right-hand cavity 129. The long edge of trapezoidal trimmer blade 128 is the sharp edge. In other embodiments, other trimmer blade 128 shapes may be used. Various embodiments may have a differently shaped retaining bore 127, multiple training bores 127, or use one or more indentations in the blade edge as alignment keys. Only about half of the sharp edge of the trimmer blade 128 is used at a time. It may be useful for the blades 128 and bores 127 to be bilaterally symmetrical (see 128 in FIG. 2) so that the blade may be reversed after it gets dull. In an alternate embodiment, each trimmer may use two blades 128, with the sharp edges arranged in a "V" to make the cutting more precise. In a further alternate embodiment, the two blades may be motorized, as is known in the art of electric scissors.

Trimmer base structures further comprise at least one fastener adaptation 124, such as bolt hole 124, for holding the cover plate 200 (FIG. 2) to the trimmer base structures. In some embodiments, bolt holes 124 also align with threaded bolt holes in baseplate 101 to fasten trimmer base structure 122 to baseplate 101.

Alignment bar 120 maintains the trimmer base structures 122 in alignment with each other and in a functional relationship with wheels 115–116. Alignment bar 122 may have indentations 121 to accommodate fasteners 125 (for example, nuts 125), which hold wheels 115–116 to wheel support flange 102. In some embodiments, alignment bar 120 may be attached to the wheel support flange 102. In some other embodiments, alignment bar 120 may be absent. In an alternate embodiment without alignment bar 120, trimmer base structures 122 may be integral to the handle 103 which serves to align the trimmer base structures 122.

In an alternate embodiment, trimmer base structures 122 may comprise mechanisms for adjusting the height of the top surface of each trimmer base structure 122 relative to the top surface of baseplate 101. For example, the trimmer base structure may comprise a scissor jack mechanism with a height adjustment knob which the user can easily manipulate. By adjusting the height of the trimmer base structure 122, the operational height of trimmer blade 128 is adjusted, thus changing the length of the trimmed, tuckable edge 802 (FIGS. 7–8) of the carpet.

Figures 2A, 2B:
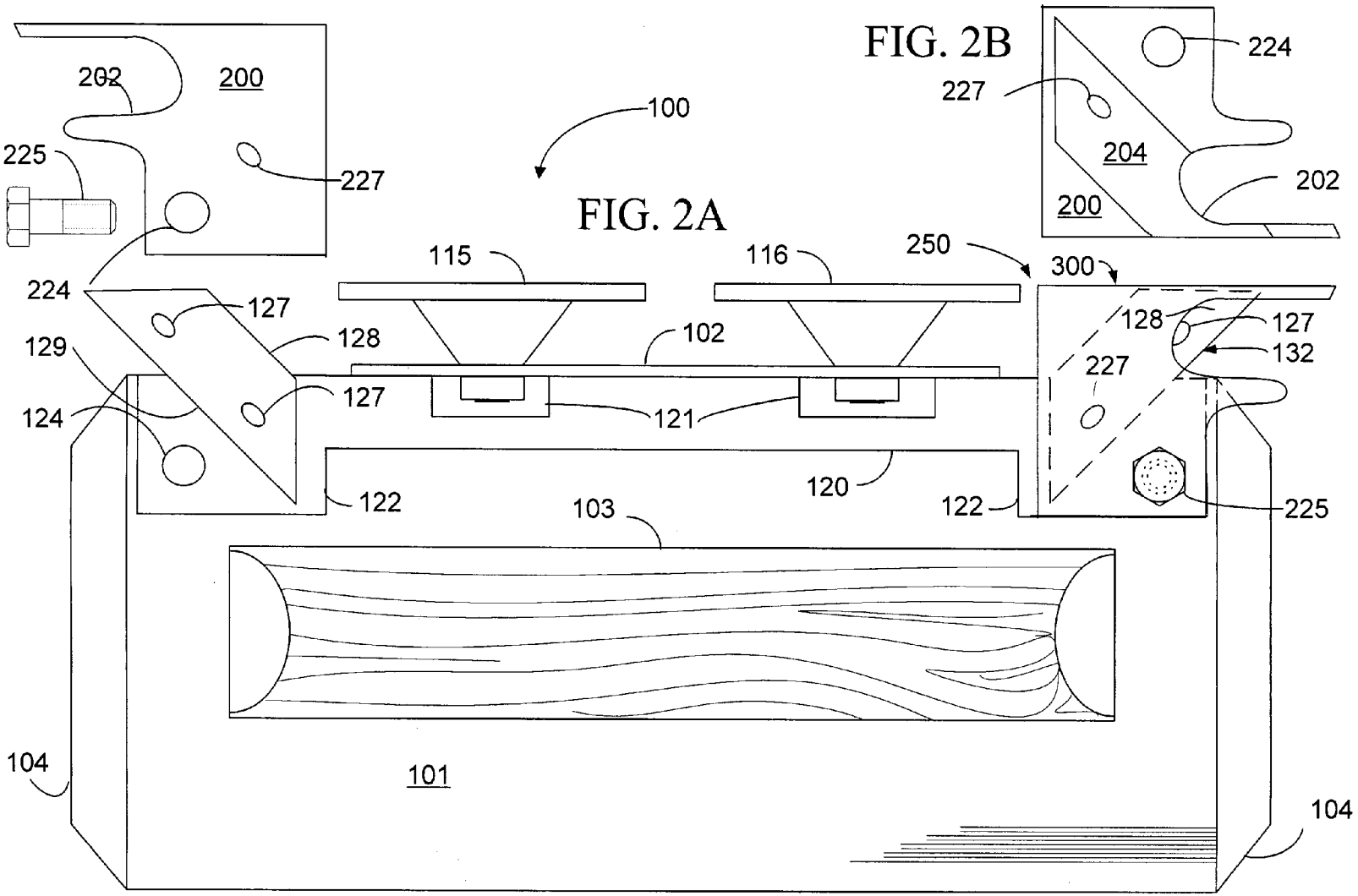
FIG. 2A is a top plan view of an exemplary embodiment of the carpet trimmer and tucker with details of the trimmer cover plates.
FIG. 2B is a bottom plan view of an exemplary embodiment of the cover plate.

FIG. 2A shows a top plan view of an exemplary embodiment of a carpet trimmer and tucker 100 with cover plates 200 and fasteners 225 for safety. Referring to cover plate 200 on the left side of the drawing, cover plate 200 comprises a shaped plate having at least one adaptation 224 for a fastener 225. For example, a bolt hole 224, aligns with bolt hole 124 in the trimmer base structure 122, for receiving bolt 225 to fasten cover plate 200 to base support structure 122. Cover plate 200 may form a trimmer blade cavity for holding a portion of trimmer blade 128 when cover plate 200 covers indentation 129 in the trimmer base structure 122. Channel 202 functions to guide the carpet to the trimmer blade 128. Retaining mechanism adaptation 227 may be a retaining bore 227 which aligns with retaining bore 127 in trimmer blade 128 and bore 126 in trimmer base structure 122 to receive a retaining pin.

On the right side of FIG. 2A, cover plate 200 is shown installed on the trimmer base structure 122 using fastener 225 to form trimmer 250. Trimmer blade 128 is installed in the blade trimmer cavity 129 and 204 with a sharpened edge 132 (FIG. 1) exposed within carpet channel 202. The portion of the trimmer blade 128 inside the trimmer blade cavity 129 and 204 is shown using a dashed line. The shape of channel 202 is exemplary and the invention contemplates a wide variety of shapes that will confine the carpet edge sufficiently to permit trimming. Cover plate 200 may be made of metal, ceramic, composites, including carbon fiber and boron-epoxy composites, or other rigid material.

The cover plate 200 may comprise a guide 300 adapted to slide along a wall 612 (FIG. 6) or baseboard 614 (FIG. 6) to maintain wheels 115–116 the proper distance from the wall 612 or baseboard 614. In exemplary embodiment 100, the guide is aligned to the wheels 115–116. In some embodiments, the cover plate may maintain the guide 300 farther out than the wheels 115–116. For example, where the baseboard 614 is short, it may be desirable to extend the guide over the baseboard 614 to engage the wall 612. In an alternate embodiment, the extension of the guide 300 from the cover plate 200 may be adjustable. For example, a screw adjustment may be provided for adjusting the extension of the guide 300 from the cover plate 200. In other embodiments, the guide 300 may comprise a horizontally disposed wheel adapted to role along the wall 612 or baseboard 614.

Cover plate 200 may be fastened to trimmer base structure 122 with one or more fasteners 225. In embodiments without an alignment bar 120, a plurality of fasteners 225 may be preferred to prevent rotation of the cover plate 200 about the fastener 225, particularly where the fasteners 225 also connect the trimmer base structure 122 to the baseplate 101. In an alternate embodiment, the cover plate 200 may be permanently affixed to the trimmer base structure 122. In another alternate embodiment, cover plate 200 and trimmer base structure 122 may be integral and comprise a machined-out trimmer blade cavity.

FIG. 2B shows the under side of an exemplary cover plate 200 comprising indentation 204 for forming the trimmer blade cavity. Alternatively, the trimmer blade cavity may be entirely in the top of the trimmer base structure 122, as with trimmer blade cavity indentation 129. In some embodiments, the trimmer blade cavity may be formed by aligned indentations 204 and 129 in the cover plate 200 and in the trimmer base structure 122, respectively.

Figures 2B, 3A, 3B, 3C:
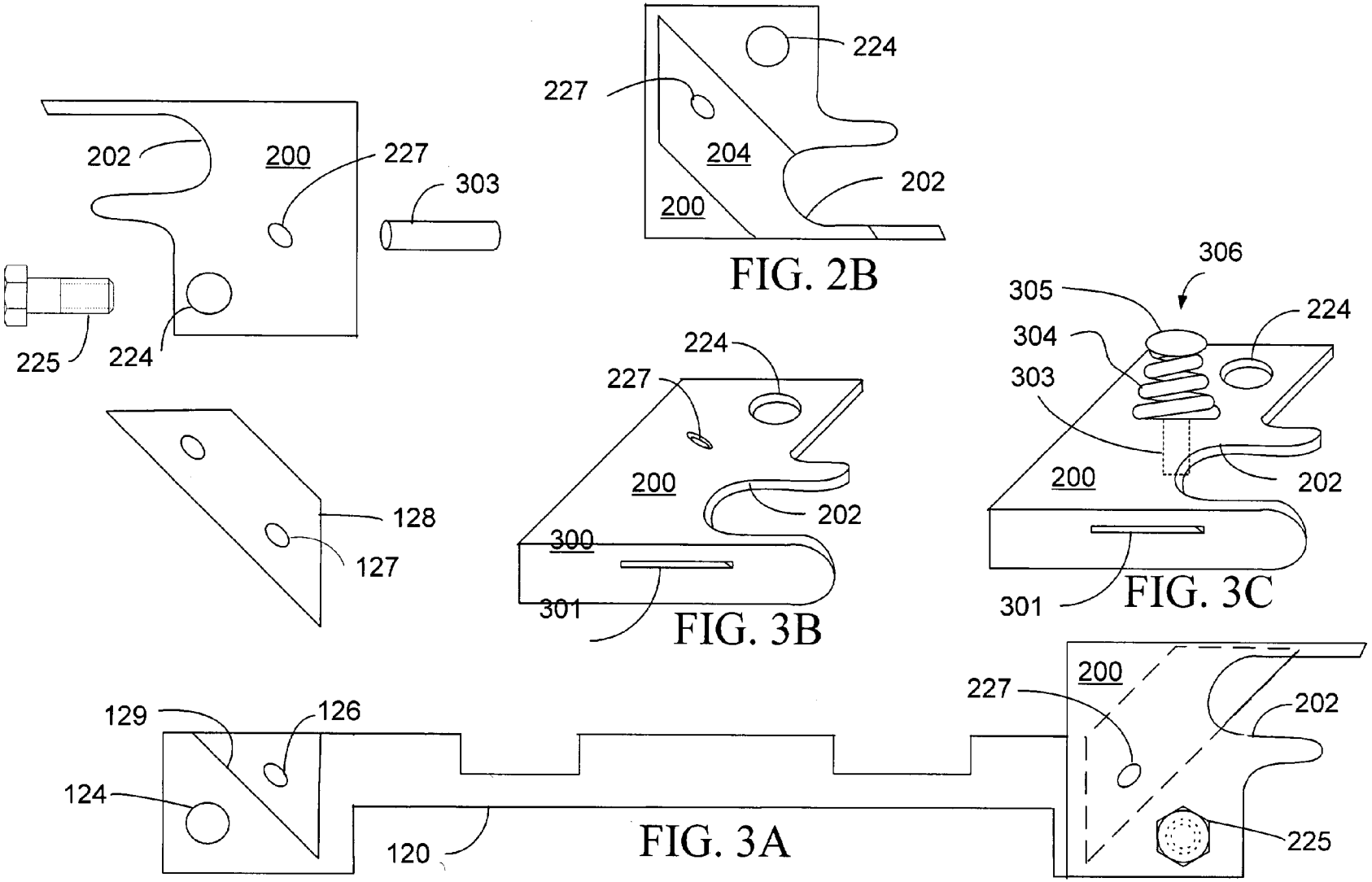
FIG. 3A is a top plan view of an exemplary embodiment of the carpet trimmers.
FIGS. 3B–3C are perspective views of exemplary cover plates with integral guides.

FIG. 3A shows the exemplary alignment bar 120 and integral trimmer base structures 122 apart from the baseplate 101. FIG. 3A shows the alignment of retaining mechanism adaptations, such as retaining pin bores 227, 127, and 126 to receive retaining pin 303. A variety of retaining mechanisms are contemplated by the invention. The bores 227, 127, and 126 may be of any cross-sectional shape. The use of retaining pins, locks, clamps, and the like are within the scope of the invention.

Figure 6:
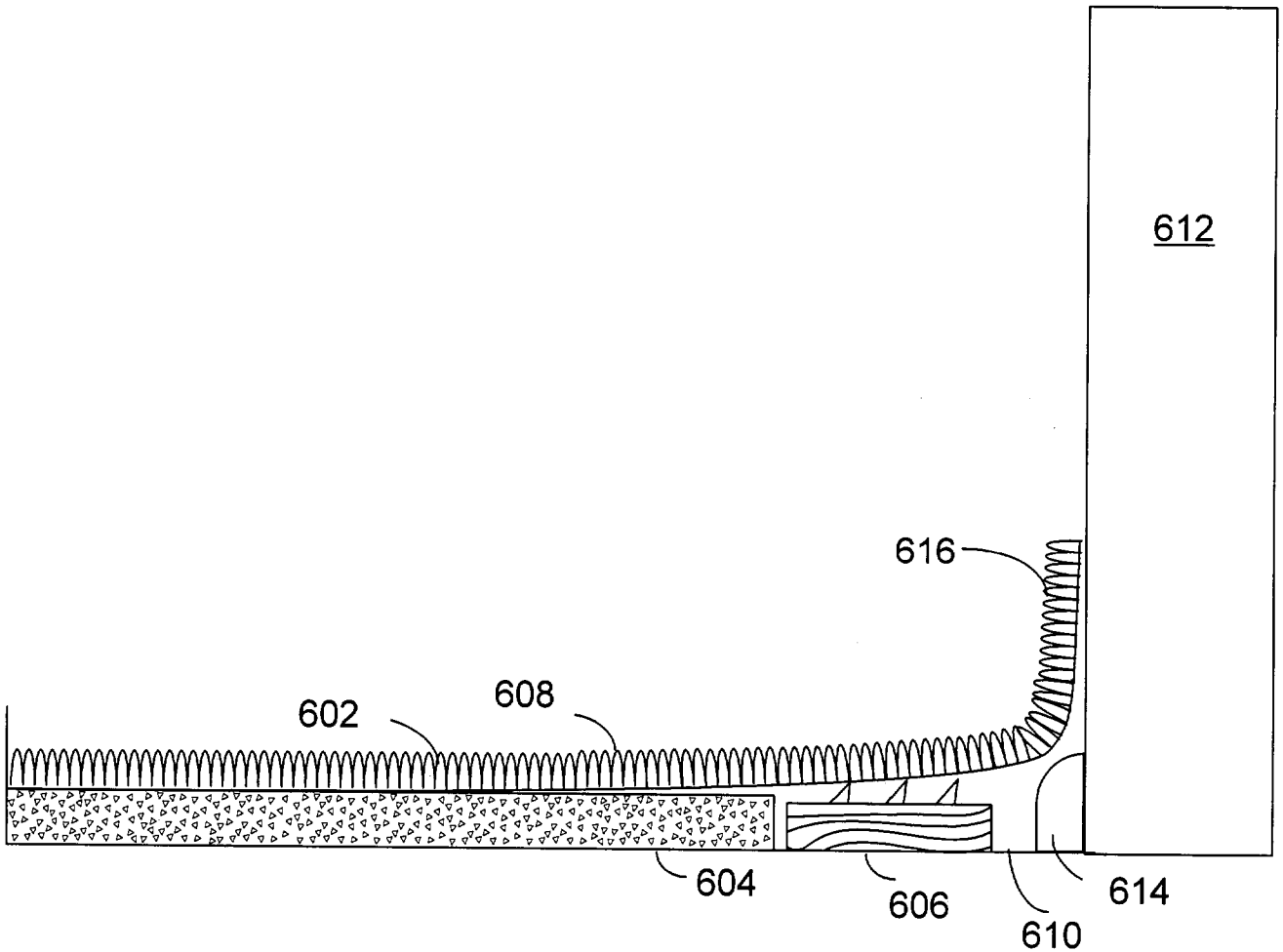
FIG. 6 is a side elevation view of carpet that needs to be trimmed and tucked.

FIG. 3B shows the exemplary cover plate 200 and integral guide 300 in a perspective view. Slot 301 in guide 300 provides access to the blade trimmer cavity for removing an old trimmer blade 128 and inserting a new trimmer blade 128. Slot 301 makes it unnecessary to loosen fastener 225 (FIG. 3A) in order to change trimmer blade 128. The slot 301 may alternatively be located on one of the other sides of the trimmer 250 (FIG. 2A) and adapted in shape and size accordingly. The end of guide 300 which initially engages the carpet may be rounded, as shown, and tapered. Tapering makes it easier to catch carpet that is resting against the wall 612 or baseboard 614 (FIG. 6).

FIG. 3C shows an exemplary retaining mechanism 306 comprising a biasing mechanism 304, or spring 304, retaining pin 303, and knob 305. Spring 304 tension biases retaining pin 303 into the inserted position. The user may pull upward on the knob 305 against the tension of spring 304 to extract pin 303 from the aligned retaining bores 227, 127, and 126, thereby releasing the trimmer blade 128.

Figures 4A, 4B, 4C:
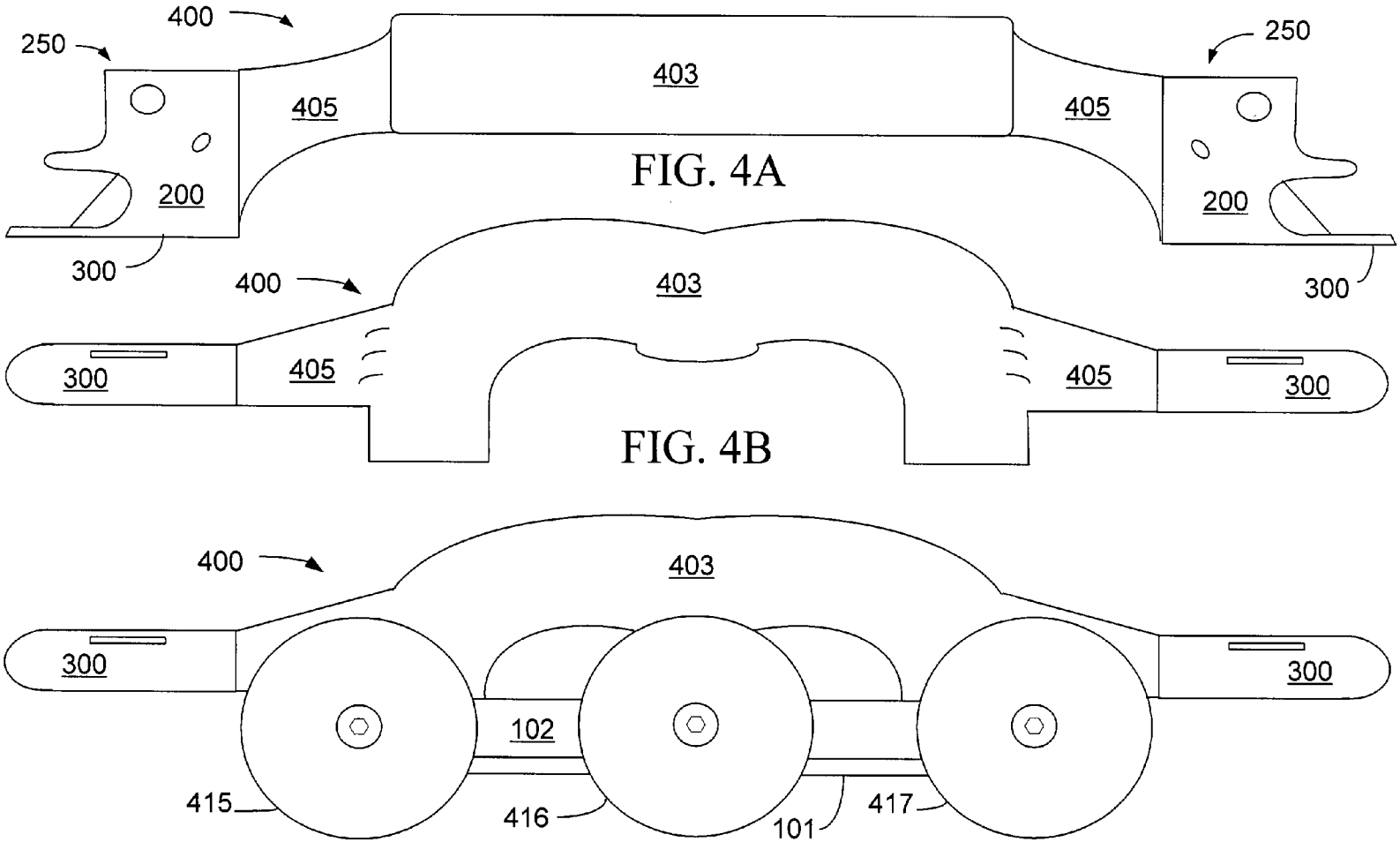
FIG. 4A is top plan view elevation view of an exemplary embodiment of the retrofit trimmers.
FIG. 4B is a side elevation view of an exemplary embodiment of the retrofit trimmers.
FIG. 4C is a side elevation view of an exemplary embodiment of the retrofit trimmers on an existing baseplate of a 3-wheeled carpet tucker.

FIG. 4A shows a top plan view of exemplary retrofit kit 400 for use with trimmers 250 (FIG. 2) and is adapted to existing 3-wheeled carpet tuckers. The trimmers 250 (FIG. 2) are integral with extensions 405 which are integral to grip 403. The retrofit kit may further comprise new fasteners for attaching the retrofit kit 400 in place of the handle of the original carpet tucker. Extensions 405 may be made of any rigid material. Trimmers 250 may alternatively be any of the adjustable embodiments discussed above. In alternate embodiments, the retro fit kit 400 may comprise integral extensions 405 and trimmers 250, wherein the extensions attach to the original handle. In yet another alternate embodiment, retrofit kit comprises discrete trimmers 250, extensions 405, and grip 403, which may be connected to a carpet tucker to form a carpet trimmer and tucker. In some alternate embodiments, extensions 405 may be adjustable in size and/or orientation.

FIG. 4B shows a side elevation view of the exemplary retrofit kit 400. Extensions 405 are shown elevated above the lowest ends of grip 403, which lowest ends attach to the existing baseplate 101 (FIG. 4C). In alternate embodiments, extensions 405 may contact, conform to, and/or connect with baseplate 101 of the existing carpet tucker. FIG. 4C shows a side elevation view of the exemplary retrofit kit 400 installed on conventional baseplate 101 having wheel support flange 102 and wheels 415–417. In some embodiments, a carpet deflector 502 (see FIGS. 5 and 9) may be an integral or attachable part of a retrofit kit 400. The carpet deflector 502 serves as a cowling or shield to prevent carpet trimmings 816 (FIGS. 7 and 8) from becoming entangled in the wheels 415–417.

Figure 5:
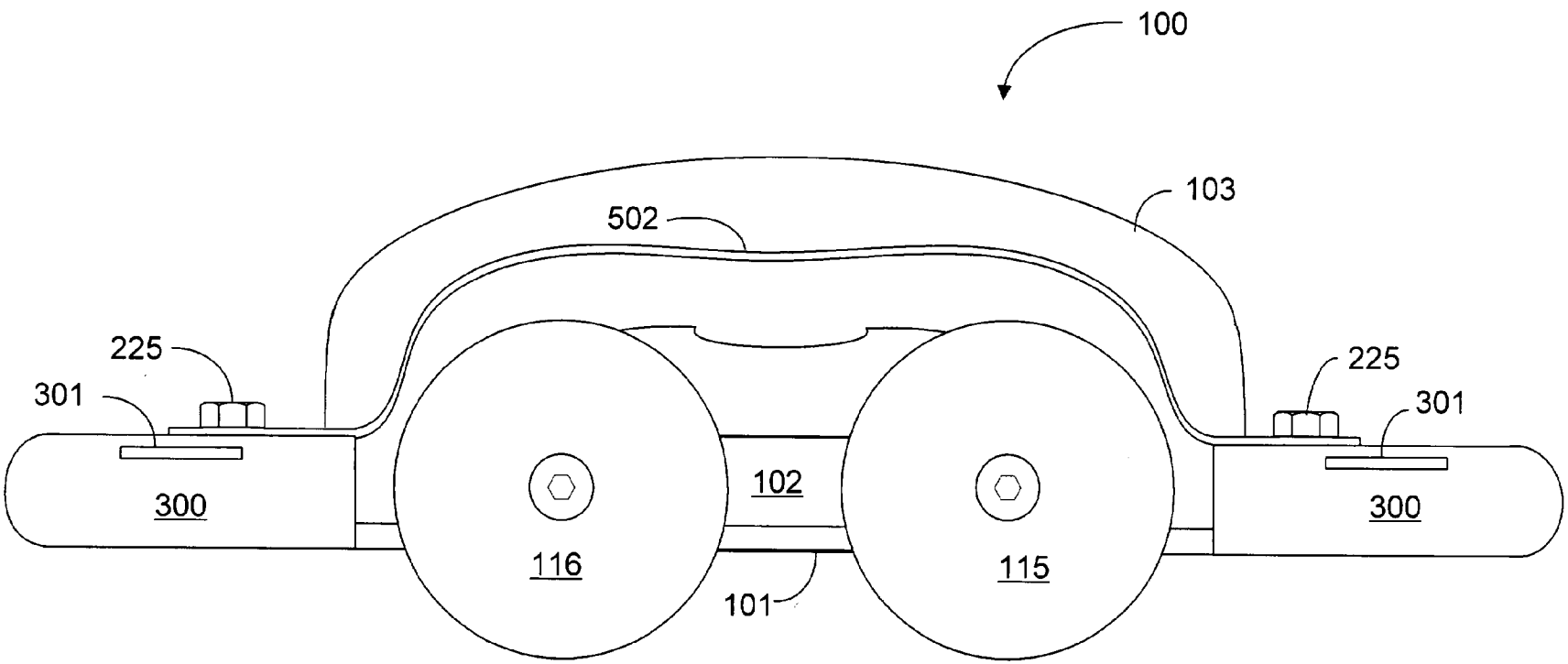
FIG. 5 is a side elevation view of an exemplary embodiment of the carpet trimmer and tucker with a carpet deflector.
Figure 9:
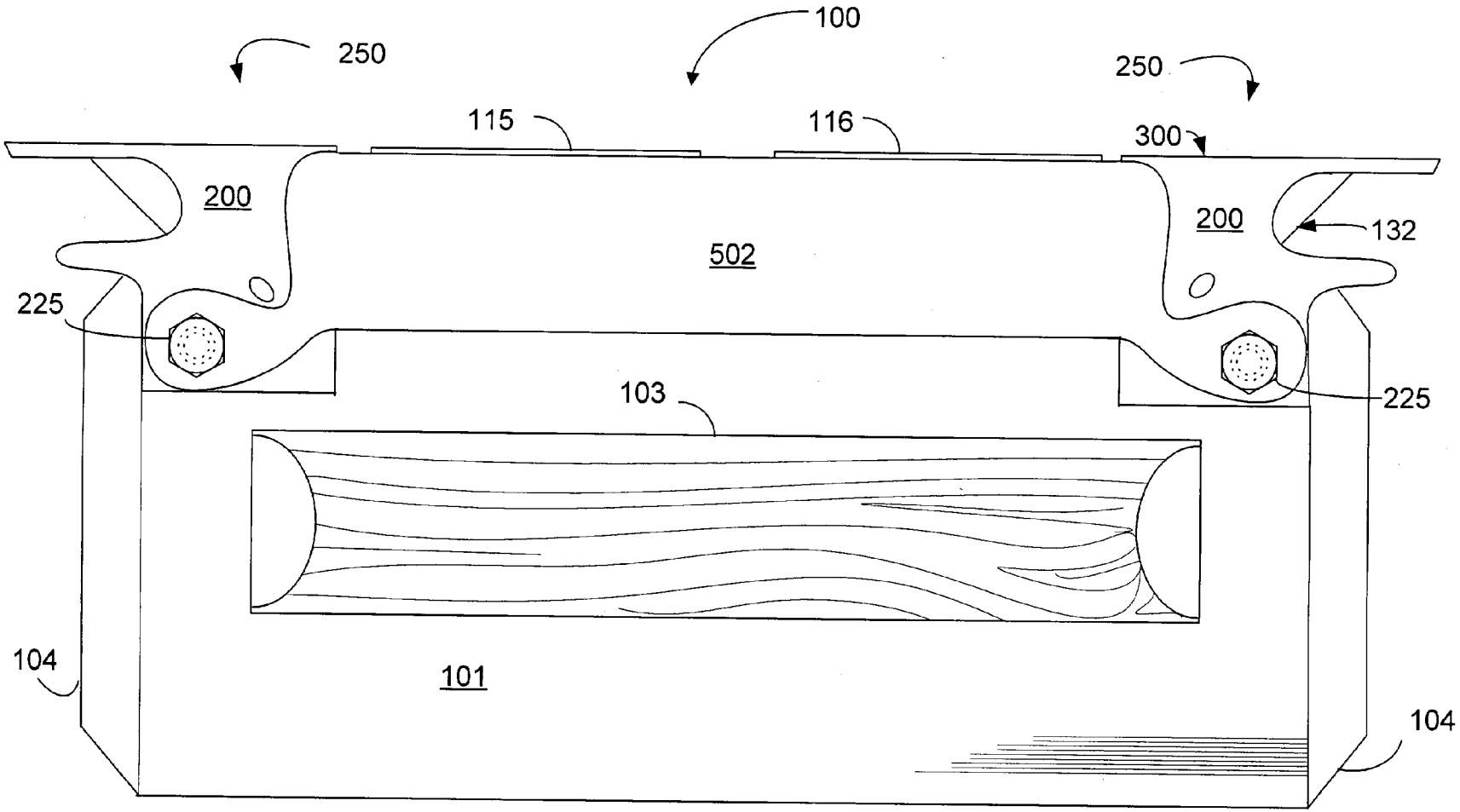
FIG. 9 is a top plan view of an exemplary embodiment of the carpet trimmer and tucker with a carpet deflector.

FIG. 5 shows a side elevation view of the exemplary embodiment 100. Carpet deflector 502 is shown attached to trimmers 250 by fasteners 225. The carpet deflector 502 deflects carpet trimmings created by the trimmers 250 in order to keep carpet trimmings from becoming entangled in the wheels. FIG. 9 shows a top plan view of the exemplary embodiment 100 with a carpet deflector 502 installed. Alternatively, the carpet deflector 502 may attach to handle 103, to baseplate 101, or to wheel support flange 102.

FIG. 6 shows a side elevation view of carpet in need of tucking and trimming. Carpet 602 rests on carpet pad 604 until a carpet portion 616 resting against the wall 612 or baseboard 614, or a carpet portion supported on the points of tacking strip 606, lifts the carpet portion 608 above the carpet pad 604. Trimming will remove excess carpet portion 616, leaving an appropriately sized carpet edge to be tucked into gap 610 between tacking strip 606 and baseboard 614 by the wheels 115–116 (FIG. 5) of the carpet trimmer and tucker 100 (FIG. 5). Conventionally, the carpet 602 is trimmed by a hand blade and then separately tucked with a carpet tucker. The conventional method is time consuming and less accurate than the present invention.

Figures 7, 8:
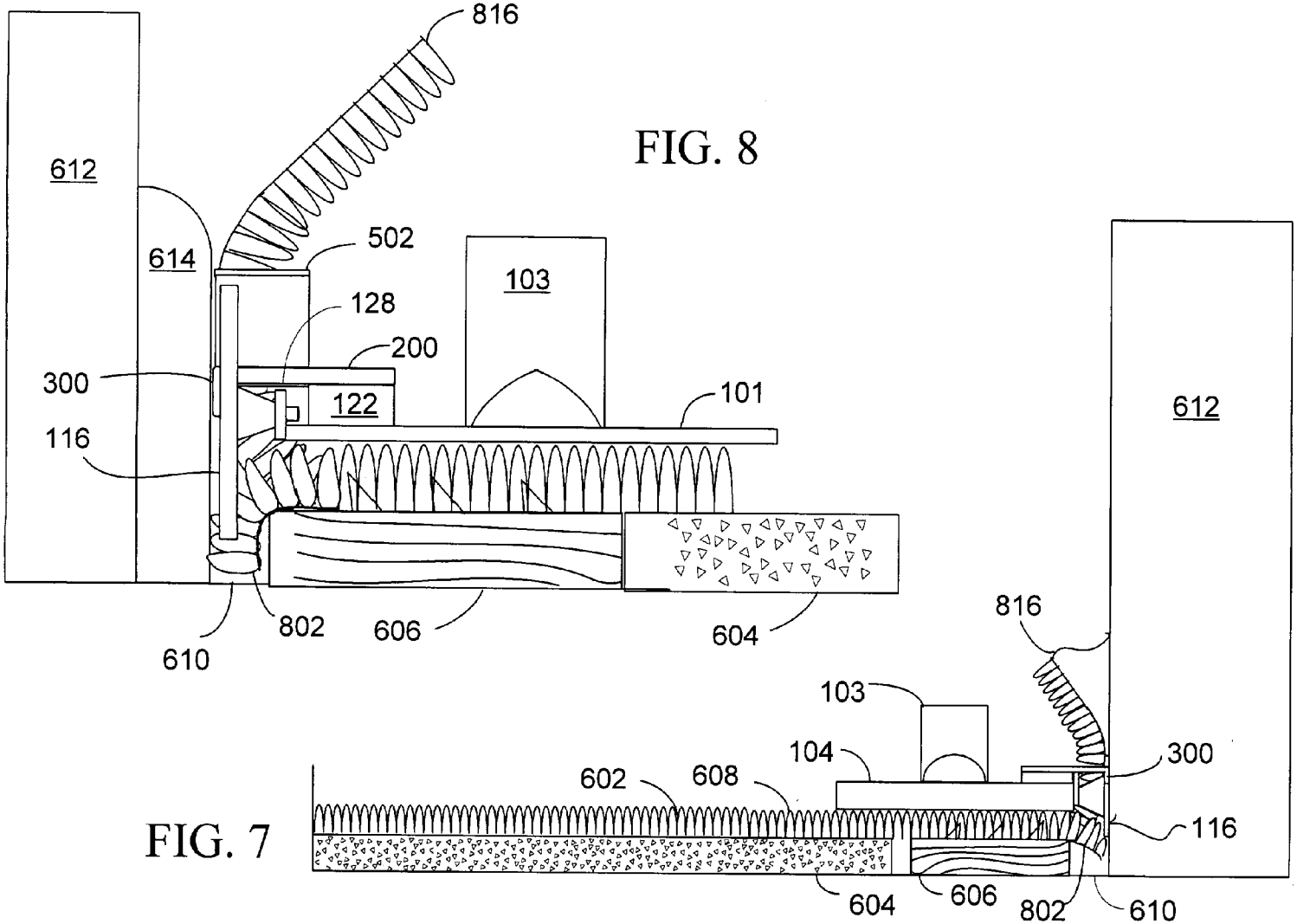
FIG. 7 is a side elevation view of an exemplary embodiment of the carpet trimmer and tucker with a carpet deflector in operation along a wall.
FIG. 8 is a side elevation view of an exemplary embodiment of the carpet trimmer and tucker with a carpet deflector in operation along a baseboard.

FIG. 7 shows an exemplary embodiment of the carpet trimmer and tucker 100 in end elevation view in operation on the carpet 602 of FIG. 6 but without a baseboard. 614. Guide 300 is flush against wall 612 as are wheels 115–116. Base plate 101, (FIG. 5) is used to press the carpet 708 down onto tacking strip 706. Inclined lip 104 eases the passage of the carpet trimmer and tucker over the carpet. Excess carpet 816 is trimmed by trimmer 250 to leave a tuckable carpet edge 802. Tuckable carpet edge 802 is tucked into gap 610, or tucking trough 610, where it is held by the natural resiliency of the material exerting forces against the wall 612 and tacking strip 606. The tacking strip 606 relieves the tucked carpet edge 802 of tension forces in carpet 702. Accordingly, the resilient forces exerted by the tucked carpet edge 802 is sufficient to retain the tucked carpet edge 802 in the tucking trough 610. The trimmed carpet 816 is conventionally discarded.

FIG. 8 shows a more detailed end elevation view of an exemplary embodiment of the carpet trimmer and tucker 100 in operation on the carpet 602 of FIG. 6. Inclined lip 104 is not shown in this view, so that the reader may appreciate the elevation of trimmer parts above the baseplate 101. In this view, guide 300 extends further outboard than the wheels 115–116, providing an offset of the wheel from the baseboard 614. Guide 300 is integral to cover plate 200 which is attached to trimmer support structure 122. Trimmer blade 128 is exposed within the carpet channel 202 (FIG. 3A) to engage excess carpet 816. Carpet deflector 502 prevents trimmed excess carpet 816 from becoming entangled in wheels 115–116. In an embodiment for short baseboards, guide 300 may be extended over the baseboard 624 to engage the wall 612, while wheels 115–116 remain in the tucking trough 610.

From FIG. 8, the reader may appreciate that for different thicknesses of carpet 602, padding 604, and tacking strips 606, different trimmer 250 heights may be needed. When the wheel heights are adjusted on the carpet tucker 100 to adapt to different carpet sizes, the size of trimmed edge 802 changes because the height of the trimmer blade 128 above the floor also changes with the wheel adjustment. However, the inherent change in trimmed edge 802 size resulting from a wheel height adjustment may not always be the correct amount of change. Accordingly, a trimmer support structure 122 may comprise a height adjustment. For example, a screw-operated scissor lift may be employed for a height adjustment. For further example, trimmer support structure 122 may comprise a plurality of plates which may be installed or removed to adjust height. Likewise, to adapt to different configurations of baseboards 614, an adjustable extension of the guide 300 is desirable. Screw-driven adjusters may be used for the purpose. Alternatively, a lockable slider may be used for the extension.

The foregoing description has described selected embodiments of a carpet trimmer and tucker. While the invention has been particularly shown and described with reference to selected embodiments thereof, it will be readily understood by one of ordinary skill in the art that, as limited only by the appended claims, various changes in form and details may be made therein without departing from the spirit and scope of the invention. For example, while the description is to a hand tool, it is possible to replace the handle with an adapter for a work boot or shoe, so that the tool may be used by a person who is in an upright position, rather than kneeling as the hand tool requires. Likewise, an extended handle, such as a shovel handle, may be used to allow for use of th ecarpet trimmer and tucker while standing.

What is claimed is:

1. A device for trimming and tucking carpet, the device comprising:

a base plate, the base plate comprising at least one straight edge;

a plurality of wheels, the plurality of wheels attached in line along one of the at least one straight edge;

a handle coupled to the base plate, wherein the combined handle and base plate comprise a base unit for the device; and at least one carpet trimmer mounted on the base unit, wherein the at least one carpet trimmer comprises a trimmer blade.

2. The device in claim 1, wherein each at least one carpet trimmer comprises a horizontally-oriented trimmer blade.

3. The device in claim 1, further comprising an adjuster associated with both the plurality of wheels and the base plate and configured to adjust the vertical position of the wheels with respect to the base plate.

4. The device in claim 1, further comprising at least one adjuster associated with both the at least one trimmer and the base plate and configured to adjust the vertical position of the at least one trimmer with respect to at least one of the base plate and the handle.

5. The device in claim 1, further comprising a carpet deflector, the carpet deflector comprising a cowling connected to the base unit, the cowling adapted to deflect carpet trimmings away from the plurality of wheels.

6. A device for trimming and tucking carpet, the device comprising:

a substantially rectangular base plate having a long edge and a short edge further comprising a substantially rectangular wheel support flange coupled at approximately a right angle to the long edge of the base plate;

a handle connected to the base plate, wherein the combined handle and base plate comprise a base unit for the device;

a first wheel connected to the wheel support flange;

a second wheel, the second wheel connected to the wheel support flange in line with the first wheel;

a first trimmer connected to the base unit proximate a first end of the base plate; and a second trimmer connected to the base unit proximate a second end of the base plate, wherein both the first and second wheels are connected to the wheel support flange in a space between the first and second trimmers.

7. The device of claim 6, wherein the first trimmer comprises a trimmer configured to operate when the device is moved in a first direction and the second trimmer comprises a trimmer configured to operate when the device is moved in a second direction.

8. The device of claim 6, comprising a relationship between each trimmer and the wheels, wherein the trimmer comprises a trimmer configured to produce a carpet edge shaped and sized to be tucked by the wheels when the device is in operation.

9. The device of claim 6, further comprising a carpet deflector, the carpet deflector attached to at least one of the base unit, the first trimmer, and the second trimmer, the carpet deflector comprising a cowling sized and shaped to deflect carpet trimming waste away from the first and second wheels.

10. The device of claim 6, wherein the first and second trimmers each comprise:

a base structure, the base structure connected to the base unit;

a cover plate, the cover plate releasably attached to the base structure;

a trimmer blade cavity between the base structure and the cover plate, the trimmer blade cavity sized and shaped to receive a first portion of a trimmer blade; and a guide member connected to at least one of the base unit and the base structure.

11. The device of claim 10, wherein the trimmer blade cavity is formed in at least one of a top of the base structure and an underside of the cover plate.

12. The device of claim 10, the device further comprising a first and a second trimmer blade respectively associated with each of the first and second trimmers, each trimmer blade having the first portion in the trimmer blade cavity and a second portion outside of the trimmer blade cavity, the second portion comprising a sharpened edge.

13. The device of claim 12, wherein the first and second trimmers each further comprise a trimmer blade retaining mechanism associated with the trimmer blade cavity.

14. The device of claim 13, wherein the retaining mechanism comprises at least one of a bore and a shaped edge portion, the retaining mechanism aligning with a bore in the base structure and a bore in the cover plate to receive a retaining pin.

15. The device of claim 14, wherein the retaining pin comprises a bias mechanism, the bias mechanism biasing the pin toward an inserted position.

16. The device of claim 10, wherein the cover plate comprises a channel extending from the exposed sharp edge of the trimmer blade, the channel operable to conduct carpet to the exposed sharp edge of the trimmer blade when the device is being operated.

17. The device according to claim 10, wherein the base structure comprises a height relative to the base plate, the height adjustable to produce a length of carpet edge to be tucked by the first and second wheels.

18. The device according to claim 10, wherein the guide member comprises a member having a vertical surface facing outward from the device, the vertical surface at least one of fixedly and adjustably aligned in a relationship with the first and second wheels, the relationship operable to maintain the wheels in a tucking trough when the vertical surface slides horizontally against and parallel to at least one of a wall and a baseboard.

19. The device according to claim 18, wherein the vertical surface comprises a slot, the slot opening into the trimmer blade cavity, the slot sized and shaped to receive the first portion the trimmer blade into the trimmer blade cavity.

20. The device according to claim 18, wherein the vertical surface is at least one of finished and treated to lower the coefficient of friction.

21. The device according to claim 18, wherein the vertical surface comprises the tread of a horizontally disposed wheel.

* * * * *